US005775972A

United States Patent [19]

Siu

[11] Patent Number: 5,775,972

[45] Date of Patent: Jul. 7, 1998

[54] TOY VEHICLE WITH AN IMPROVED STEERING MECHANISM

[75] Inventor: Wai-Hung Siu, Kowloon, Hong Kong

[73] Assignee: Energetic Industrial Technology Ltd., Hong Kong

[21] Appl. No.: 695,204

[22] Filed: Aug. 1, 1996

[51] Int. Cl.[6] ..... A63H 17/36; A63H 17/26; A63H 18/00

[52] U.S. Cl. ..... 446/468; 446/466; 446/460; 280/112.2

[58] Field of Search ..... 446/468, 469, 446/466, 460, 456, 454; 280/772, 112.2, 111, 95.1

[56] References Cited

U.S. PATENT DOCUMENTS

| | | | |
|---|---|---|---|
| 2,224,408 | 12/1940 | Peglow | 267/286 |
| 2,386,745 | 10/1945 | Yarbrough | 446/468 |
| 3,820,809 | 6/1974 | Blonar | 280/112.2 |
| 4,272,917 | 6/1981 | Smith, III et al. | 446/456 |
| 5,312,288 | 5/1994 | Williams | 446/466 X |

FOREIGN PATENT DOCUMENTS

| | | | |
|---|---|---|---|
| 77599 | 2/1962 | France | 446/469 |
| 0286513 | 1/1991 | Germany | 446/468 |

*Primary Examiner*—D. Neal Muir

*Attorney, Agent, or Firm*—Burns, Doane, Swecker & Mathis, L.L.P.

[57] ABSTRACT

A toy vehicle having a rigid chassis, a steering control mechanism, and first and second wheels which are controllable by the steering control mechanism to steer a vehicle. A cam and step arrangement selectively redistributes the effective weight acting on first and second wheels so as to increase the relative effective weight on the one of the first and second wheels on the side of the vehicle to which the vehicle is desired to turn.

4 Claims, 10 Drawing Sheets

TOY VEHICLE WITH AN IMPROVED STEERING MECHANISM

FIELD OF THE INVENTION

The present invention relates generally to a toy vehicle and, in particular, to a toy vehicle with an improved steering mechanism, and more particularly, it relates to a radio-controlled toy vehicle having a steering improvement arrangement which considerably reduces the turning radius.

BACKGROUND OF THE INVENTION

Toy vehicles, and in particular radio-controlled toy vehicles which simulate the performance and motion of a real vehicle, are very popular among children. The performance of a toy vehicle is sometimes measured by its ease of maneuver or flexibility, including the ability to turn with a small turning radius. The turning radius of a toy vehicle is usually determined by the axle distance between the front and rear wheels together with the maximum allowable angular swing of the plane of the front wheels which could still provide an acceptable performance.

To reduce the turning radius to less than what is otherwise limited by the axle distance and the swing angle of the front wheels, differential gears which produce different speeds or different directions of rotation on the left and right wheels may be utilised in combination with ordinary steering mechanisms. While the performance of those steering systems using differential gears is highly rated, they are nevertheless expensive and less durable because they are very complicated and involve a large number of moving components assembled together.

Accordingly, it is highly beneficial to devise a simple, and therefore low cost, steering mechanism which would also improve the steering efficiency of a toy vehicle. During experiments, it was observed that when a vehicle is loaded with extra concentrated weight on one of its front corners, it will skew to the side which is loaded with that weight, notwithstanding that it is steered to move in a straight manner. This skewing phenomenon is also observed when one of the front wheels is removed while maintaining the vehicle in a stable condition. Accordingly, it is appreciated that where the ground gripping force due to the frictional force between the wheel and the ground surface are different between the front left and right wheels, the vehicle will skew considerably towards the side of the front wheel having a higher gripping force. This skewing effect could then be utilised by either combining or counteracting with the steering effect already inherent in a conventional steering mechanism to reduce or increase respectively the turning radius.

According to the present invention, there is provided a toy vehicle having a rigid chassis, a steering control mechanism, and first and second front wheels which are connected to first and second arms respectively and which are located on first and second sides of said vehicle, each said arm is pivotally movable and said pivotal movement is controllable by said steering control mechanism to control the steering of said front wheels, and each said knuckle arm is provided with a wedging means such that when said vehicle is caused to turn to a first side said wedging means on said first knuckle arm wedges against said chassis.

Preferably a first and a second set of contoured step-levels are provided on said first and second sides of said chassis respectively, each said set of contoured step-levels comprises a lowest step-level nearest to the ground, a highest step-level furthest away from the ground and a shoulder level in between.

Preferably when said vehicle is caused to turn towards said first side, said cam member on said first side of said chassis will be positioned to be in contact with said lowest step-level of said first set of step-levels.

Preferably when said vehicle is caused to turn towards said second side, said cam member on said second side of said chassis will be positioned to be in contact said lowest step-level of said second set of step-levels.

Preferably when said vehicle is caused to move in a rectilinear manner, said cam members on both said first and second sides of said chassis will be positioned to be in contact with their respective shoulder step-levels.

According to the present invention, there is therefore provided a steering control mechanism, and first and second wheels which are controllable by said steering control mechanism to steer said vehicle, further comprising means for selectively redistributing the effective weight acting on said first and second wheels so as to increase the relative effective weight on the one of the said first and second wheels on the said of the vehicle to which the vehicle is desired to turn.

BRIEF DESCRIPTION OF THE DRAWINGS

A preferred embodiment of the present invention will now be explained by way of example and with reference to the accompanying drawings, in which.

DETAILED DESCRIPTIONS OF THE PREFERRED EMBODIMENT

Figure 1:
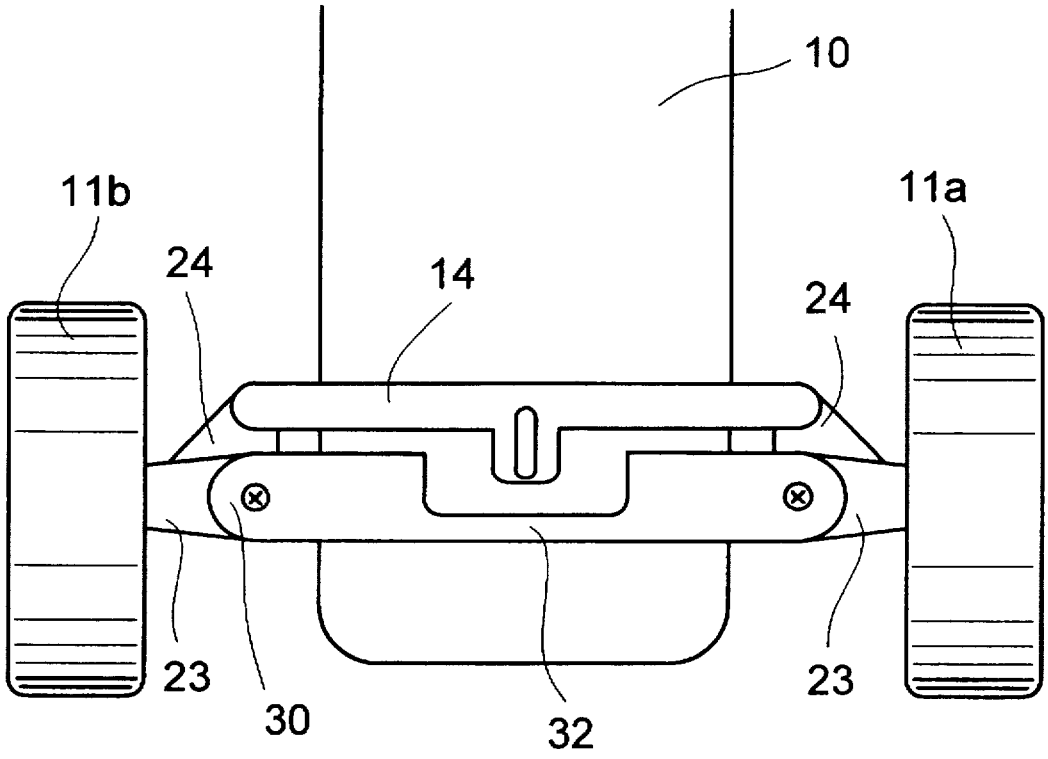
FIG. 1 shows the plan view of the steering mechanism in a centrally steered Position.

A typical vehicle toy, for example, a radio-controlled toy vehicle, usually comprises a vehicle body attached to a rigid main chassis, a driving unit, a steering mechanism, front and rear wheels and other components or devices, such as a radio receiver or gear box, which are to be mounted or secured onto the main chassis. The wheels for such vehicles are usually made of rubber or other relatively strong and resilient materials so that they will only be deformed slightly in response to extra weights comparable to the weight of the vehicle. A steering control mechanism is usually also provided to control the steering mechanism in order to achieve a desired amount of steering.

Referring to the Figures, there is shown a part of a typical vehicle toy comprising a main chassis 10 with the front steering arrangements exposed. The steering mechanism of the present embodiment comprises a pair of front wheels 11 each of which is connected to a knuckle arm 20 via a wheel shaft 12. The knuckle arm 20 is pivotally movable about a substantially vertical hinge 13 and is connectible to a steering link 14 which determines the extent of angular swing of the plane of the front wheels and direction of steering. The amount and extent of steering in the present embodiment is controlled by the lateral movement of the steering link 14 which is in turn controlled by a suitable steering control mechanism. The front wheels 11 comprise a front-left wheel 11*a* and a front-right wheel 11*b* each of which is freely rotatable about an axle 12. The axle 12 is formed as an extension from the knuckle arm 20 which is pivotally movable about the substantially vertical hinge 13. 'Vertical' in the present context connotes a direction which is normal to the plane formed by interconnecting centres of the wheels of the vehicle.

The knuckle arm 20 is a rigid member comprising a cam or wedging member 21 formed on an upper surface thereof, a protrusion member 22, first 23 and second arm 24 portions with a pivot point 25 between them. Knuckle arm 20 is slidable along the length of the shaft 13 of the vertical hinge and is limited in its movement by upper and lower flanges 30, 31. The lower flange 31 extends upwardly from the lower side of the chassis. The upper flanges in the present embodiment are formed by the overhanging ends of a detachable transversal bar 32 which is secured onto the chassis by means of fasteners such as screws 33. The combination of the overhanging upper flange 30 and the corresponding lower flange 31 form a pair of caps which limit the range of allowable vertical displacements of the knuckle arm 20 along the vertical hinge shaft 13. These caps together with the vertical hinge shaft therefore form a complete "I" shaped hinge about which the knuckle arm 20 can rotate.

The first arm portion 23 of the knuckle arm 20 is provided for connecting the wheel 11 to the chassis 10 and the second arm 24 portion is provided for connecting the first portion 23 to the steering link 14. The protrusion member 25 is provided for connecting the second arm 24 portion to the steering link. The mechanics of the knuckle arm 20 are designed so that lateral translation of the steering link 14 will act on the second arm 24 portion via the protrusion member 25, producing a torque about the hinge 13, causing pivotal movement of the first arm 23 portion about the hinge and finally causing angular movement of the plane of the wheel with respect to the vehicle body, thereby effecting a steering motion.

The weight of a vehicle toy is normally supported by its wheels. The part of the vehicle weight which is transmitted to the front wheels is normally transmitted by resting the lower surface of the upper flange 30, which is secured onto the chassis and carries this partial weight, on the knuckle arm 20 which is directly connected to the wheels. In the present embodiment, this lower surface is contoured and comprises three step-levels, the lowest step-level 41 is closest to the ground plane, the highest step-level 43 is furthest from the ground plane and the shoulder step-level 42 is between and substantially parallel to the other two. These three step-levels 41–43 are joined by connecting slopes to allow smooth transition between them and they correspond to left, right and centre steering, depending on which side of the chassis they are located.

The arrangements of these sets of step-levels are dependent on which side of the chassis they are located. The set of the step-levels on the left side, i.e. left upper flange, is arranged in such a manner that when the vehicle steering is changed from left turn to right turn, the left cam member moves from a position corresponding to the lowest step-level, passing through the shoulder and reaching the highest step-level, corresponding to left-turn, central- and right-turn steering. The step-levels on the right side of the chassis is arranged in a reverse manner such that, during the change from left to right turn, the right cam member moves from a position corresponding to the highest step-level, passing through the shoulder and reaching the lowest step-level. As are apparent from the figures, the shoulder portions 42 on both sides of the chassis are at approximately the same level from a flat ground surface.

Turning now to the operation of the steering mechanism. When the vehicle is centre steered, the shoulder portions 42 of the left- and right- upper flanges rest comfortably on the cam members. Since the distance between the ground level to both shoulder portions 42 are substantially the same, the weight attributable to the front part of the vehicle is therefore distributed substantially evenly on its left and right wheels. Under these conditions, the vehicle will move in a substantially rectilinear fashion in an ordinary manner.

Figure 3:
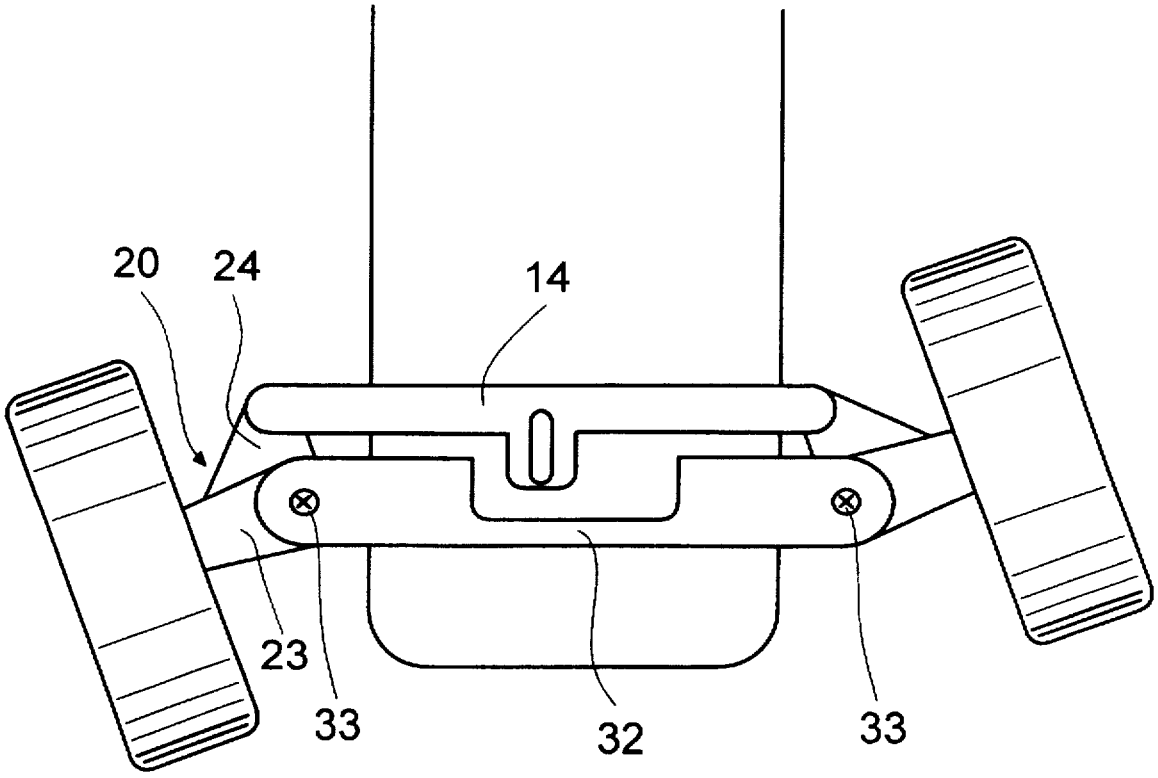
FIG. 3 shows the plan view of the mechanism of FIG. 1 steered to turn left.
Figure 4:
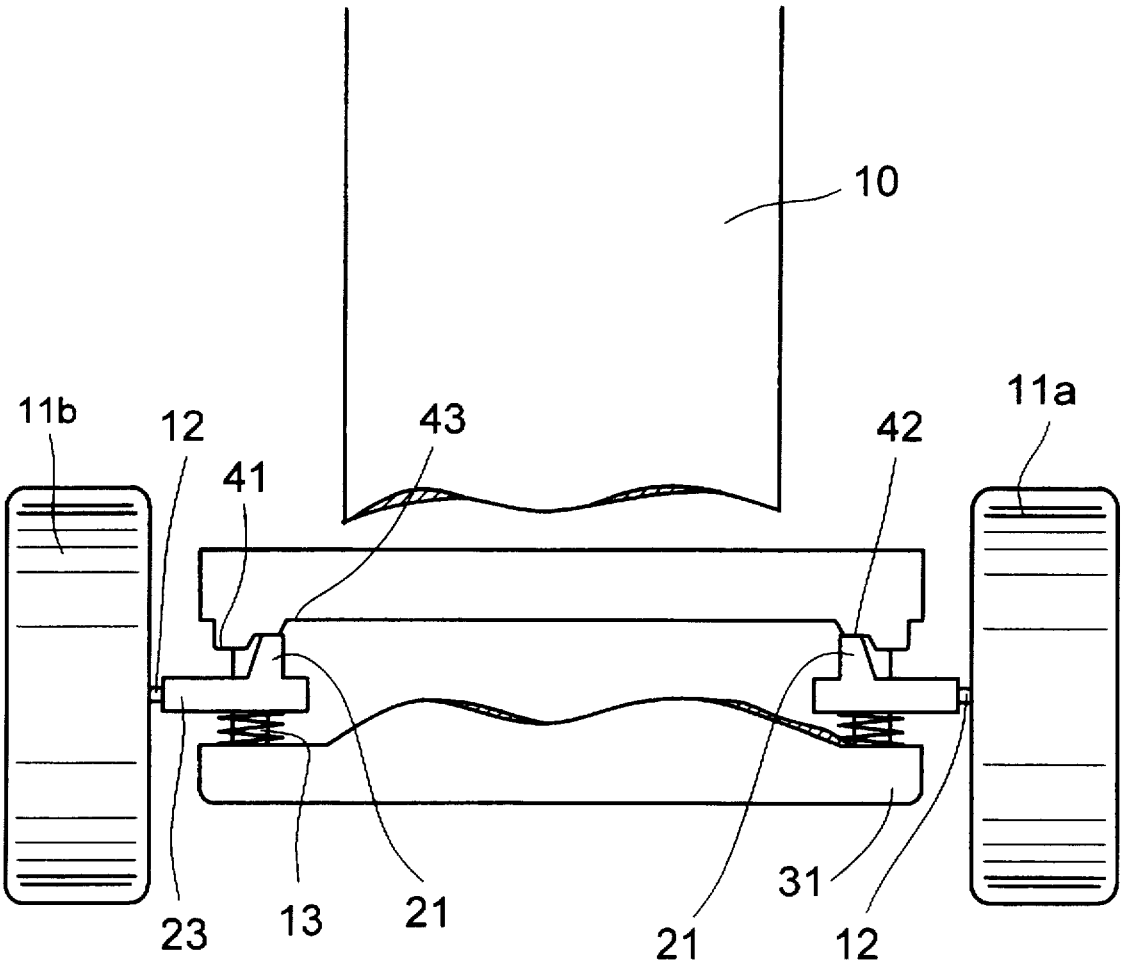
FIG. 4 is a partially exploded front view of the mechanism of FIG. 1.
Figure 5:
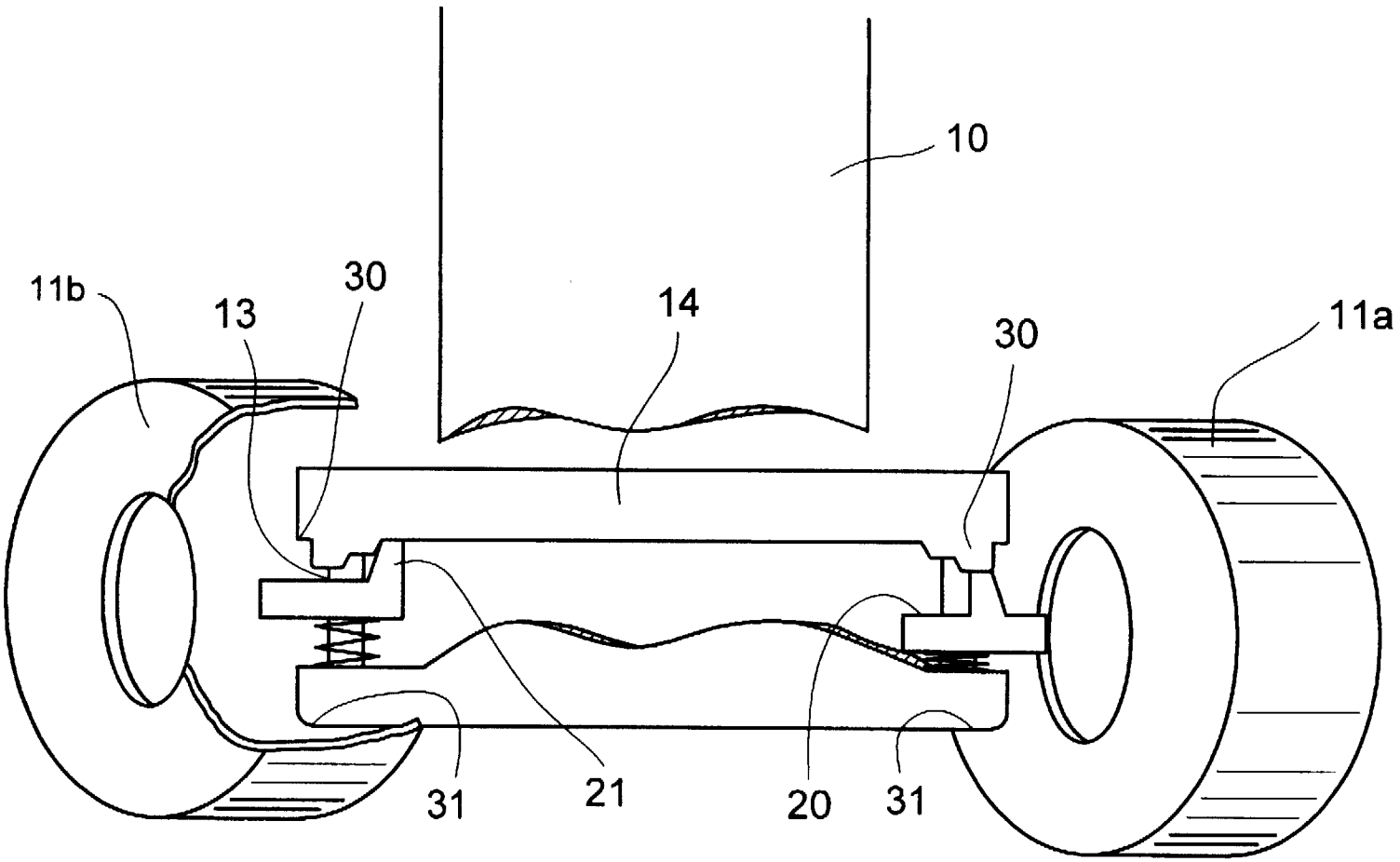
FIG. 5 is a partially exploded front view of the mechanism of FIG. 1 steered to turn left.
Figure 7:
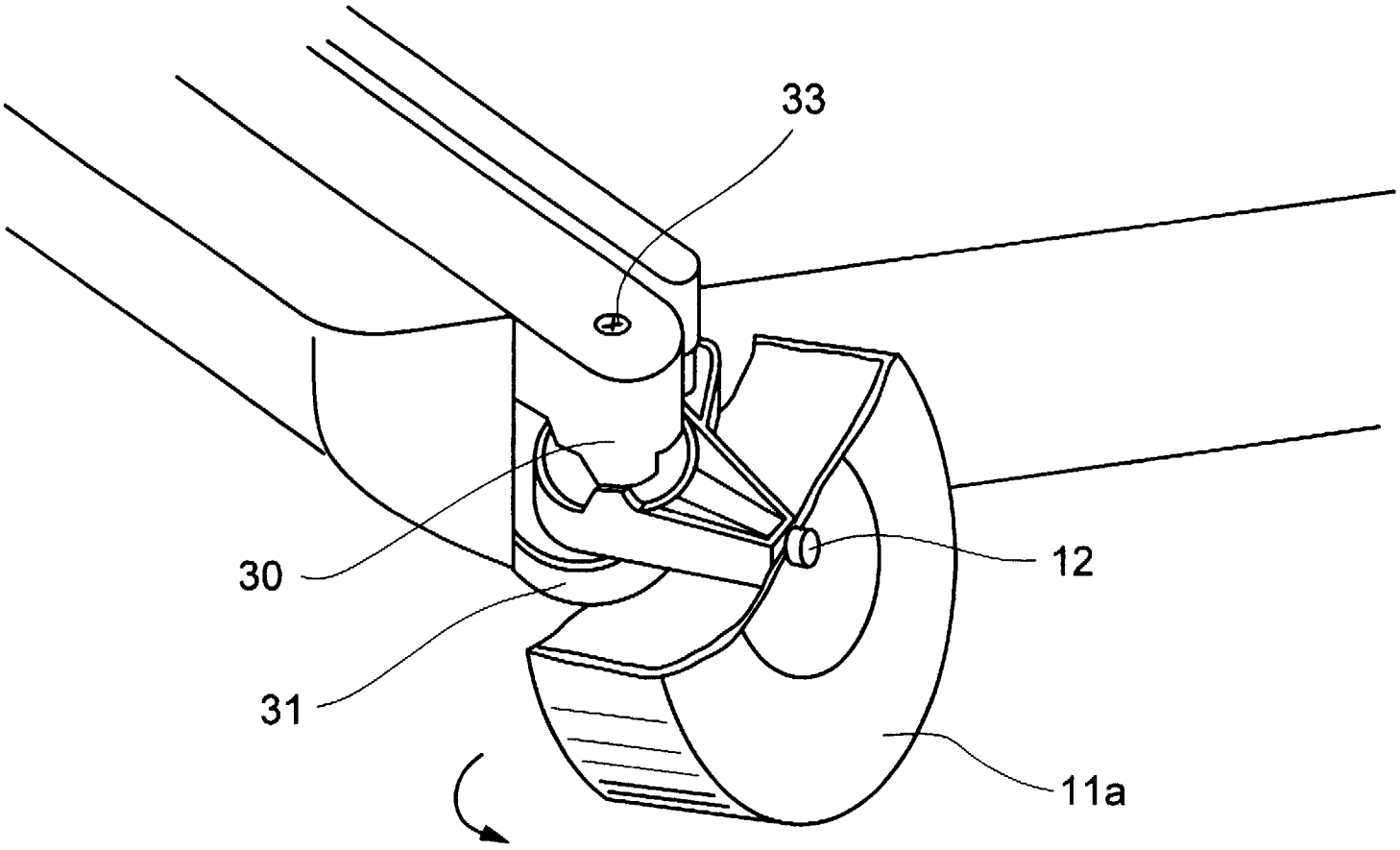
FIG. 7 is a partially exploded front perspective view showing the left knuckle arm when the mechanism of FIG. 1 is steered to turn left.

When the wheels are steered to turn left, as shown in FIGS. 3, 5 & 7, the knuckle arms are pivotally turned about their respective hinges 13. As a result of this pivotal movement, the cam or wedging member 21 on the left knuckle arm 20 follows the contour on the underside of the left upper flange 30 until it reaches and wedges against the lowest contour level 41. Since the knuckle arm 20 is slidably movable along the length of the hinge shaft 13 and since clearance of the wheel axle 12 above the ground is substantially constant because of strong nature of the material used in the wheels, this wedging by the cam member 21 will have the effect of pushing up the part of the front upper flange which is in contact with it. As a result of such wedging at the front left corner of the chassis and since the chassis is rigid, the plane of the chassis is caused to tilt about and towards the rear right wheel. At a result of such tilting, the front right corner of the chassis, including the upper- and lower-flanges, is also slightly lifted.

Since the three contoured step-levels on the right upper flange are arranged in a reverse manner to that on the left side, when the left cam member is in contact with the lowest step-level of the left upper flange, the right cam member will have been disengaged from the shoulder level 42 and moved to a position which corresponds to the highest step-level 43 of the right upper flange. The upward lifting of the front right corner of the chassis in combination the disengagement of the cam member from the shoulder level means most of the weight attributable to the front part will now be concentrated on the front left wheel, thereby increasing its grip on the ground. This increased gripping together with the steering effect with the angular swing of the front wheels will operate as aforementioned and effectively reduce the turning radius to the left.

Figure 2:
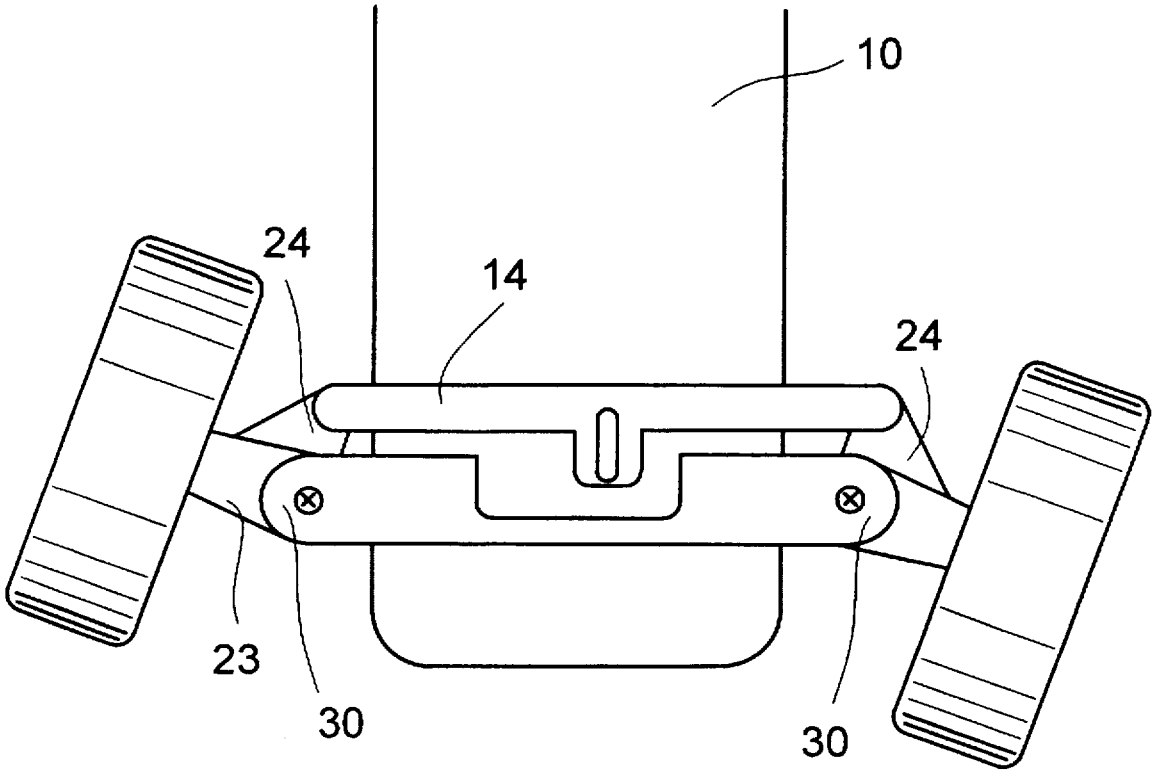
FIG. 2 shows the plan view of the mechanism of FIG. 1 steered to turn right.
Figure 6:
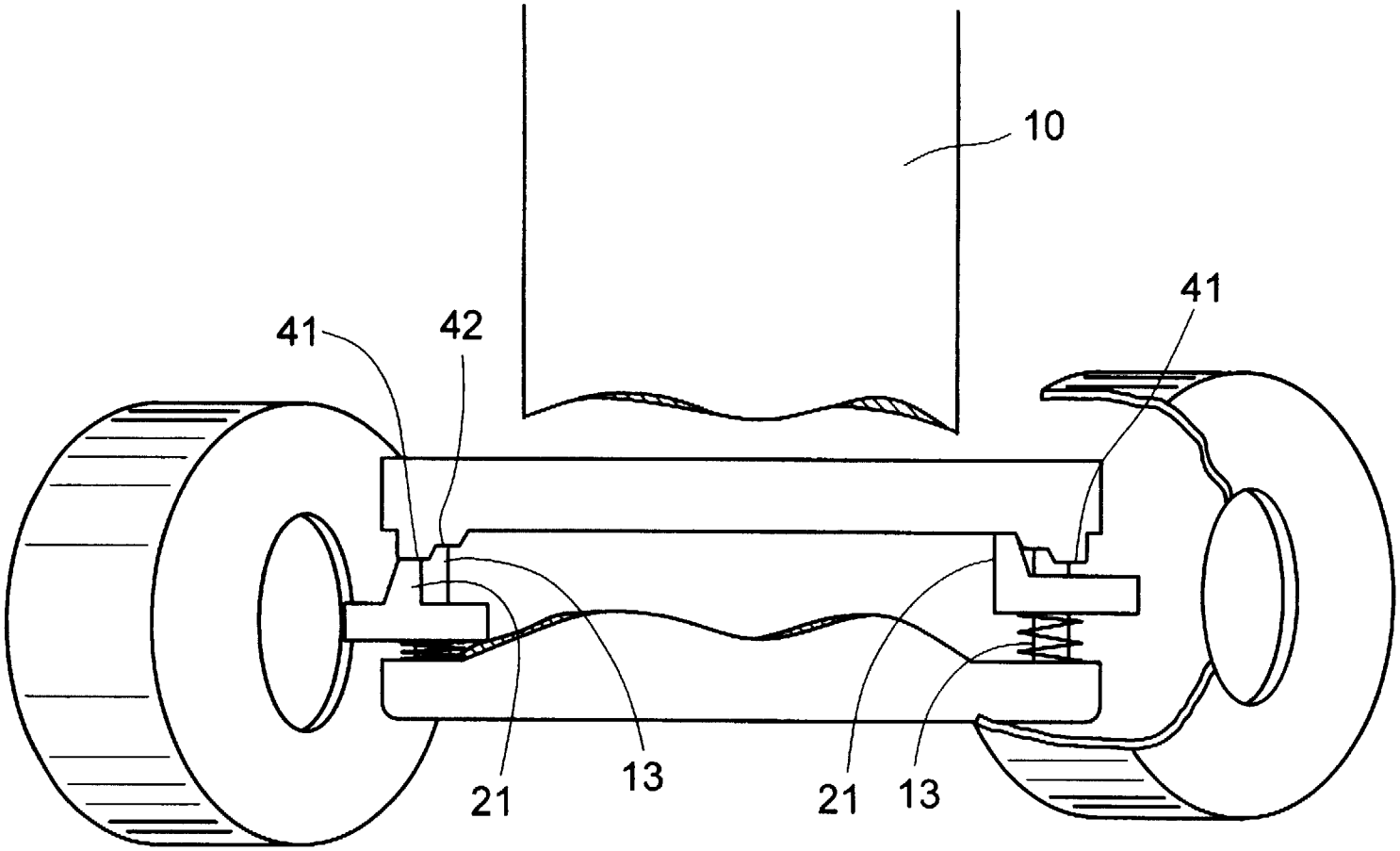
FIG. 6 is a partially exploded front view of the mechanism of FIG. 1 steered to turn right.
Figure 8:
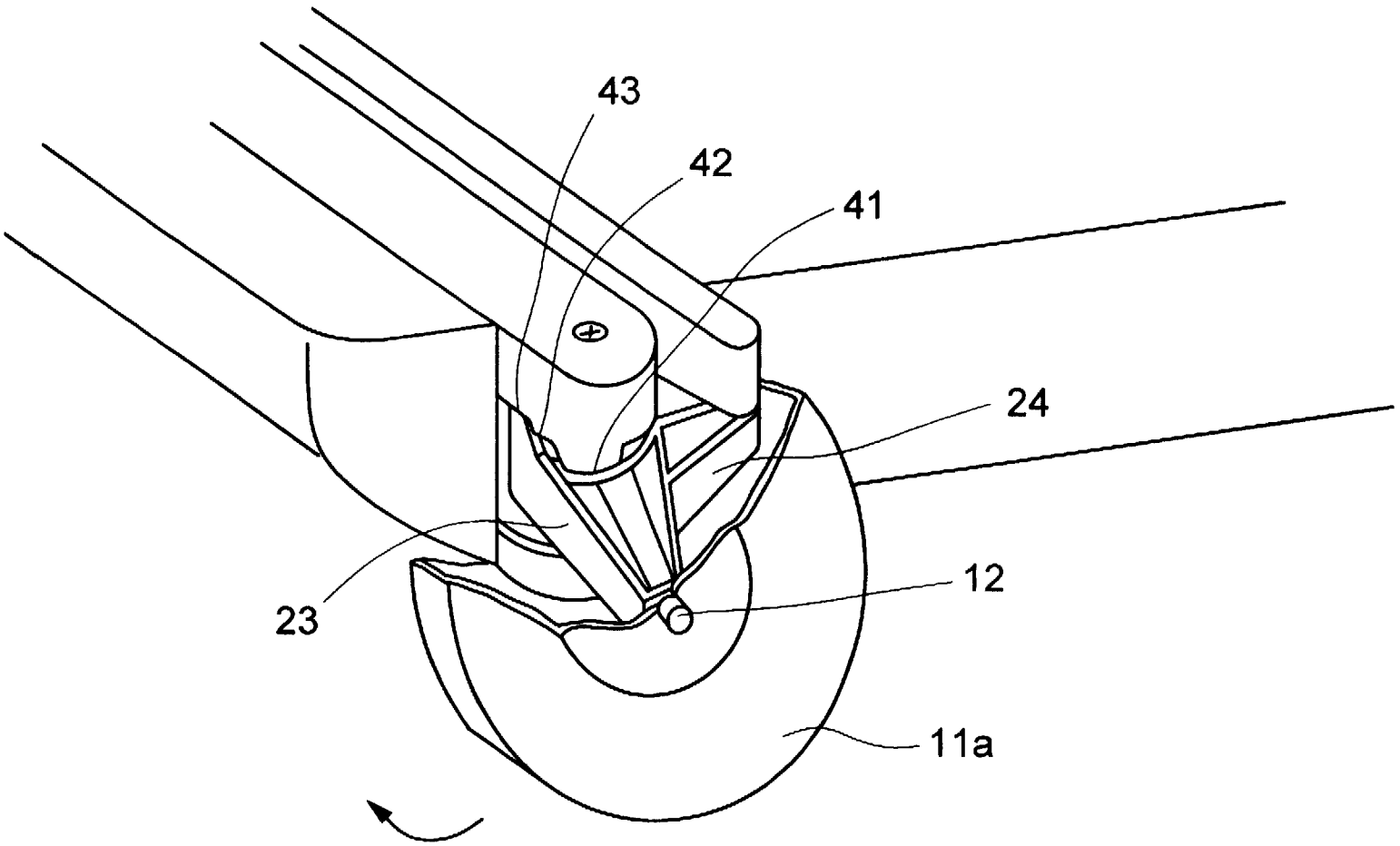
FIG. 8 is a partially exploded front perspective view showing the left knuckle arm when the mechanism of FIG. 1 is steered to turn right.
Figure 9:
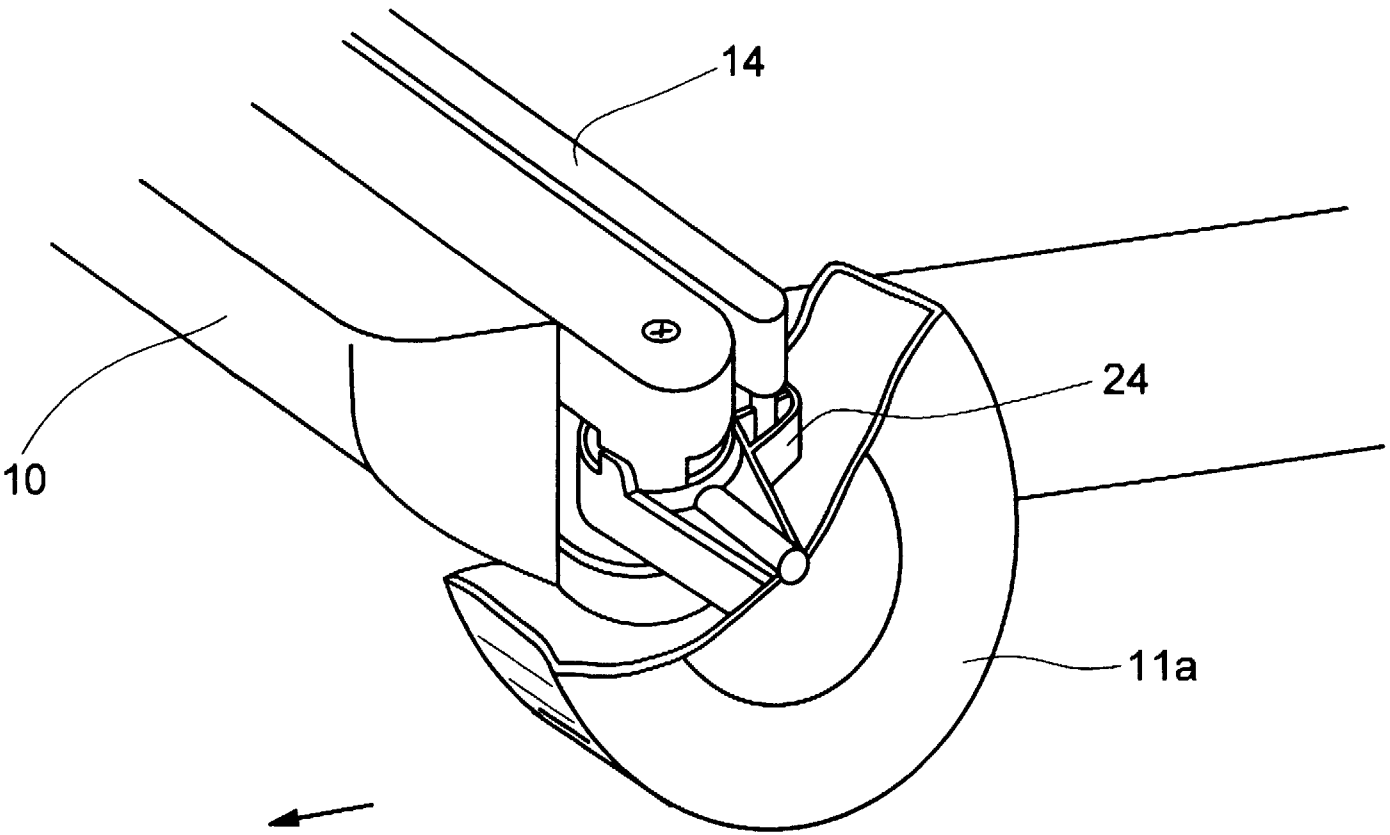
FIG. 9 is a partially exploded front perspective view showing the left knuckle arm when the mechanism of FIG. 1 is centrally steered.
Figure 10:
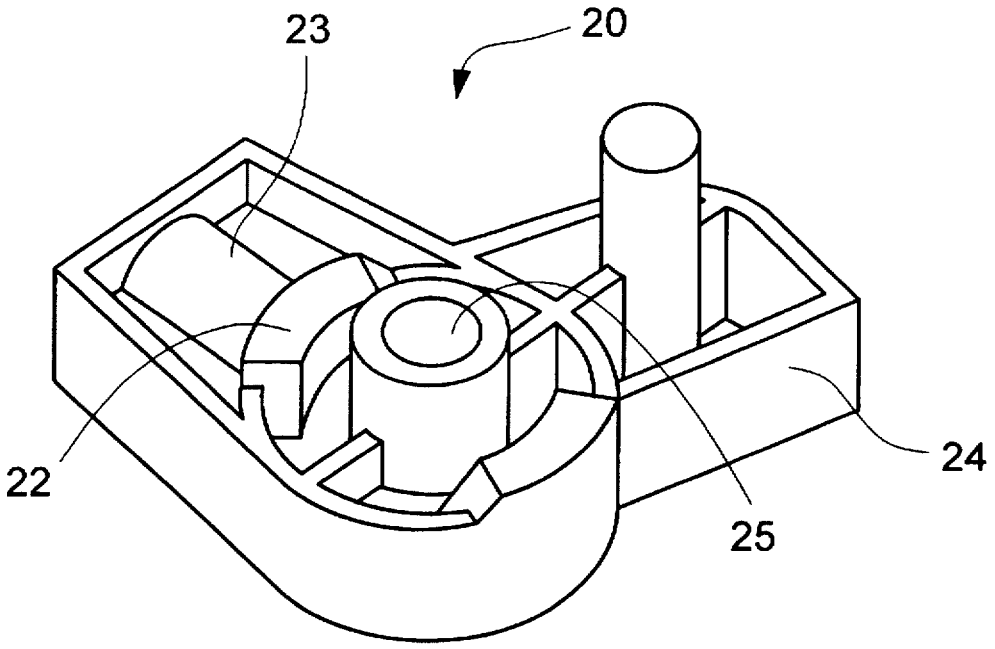
FIG. 10 is a perspective view of a right knuckle arm forming part of the mechanism of FIG. 1.
Figure 11:
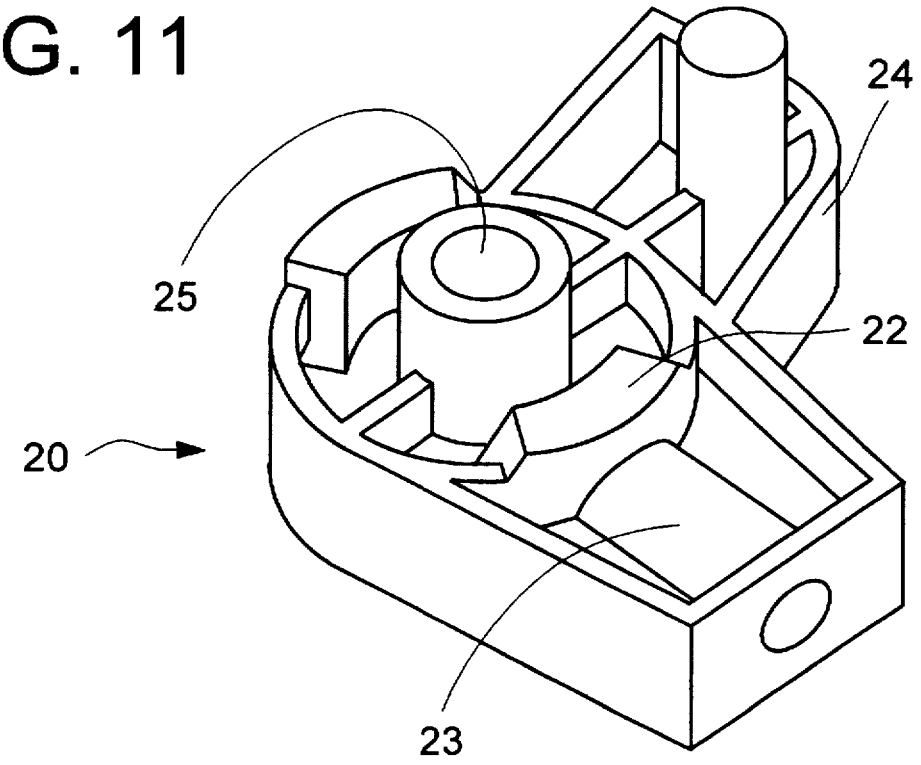
FIG. 11 is a perspective view of a left knuckle arm forming part of the mechanism of FIG. 1.

Similarly, when the wheels are steered to turn right, as shown in FIGS. 2, 6 & 8, the knuckle arms are pivotally turned about their respective hinges 13. As a result of this pivotal movement, the cam or wedging member 21 on the right knuckle arm 20 follows the contour on thee underside of the right upper flange 30 until it reaches and wedges against the lowest contour level 41. Similarly, this wedging by the cam member 21 will have the effect of pushing up the front right corner of the vehicle and causing the plane of the vehicle chassis to tilt about and towards its rear left wheel. At a result of such tilting, the front left corner of the chassis is also slightly lifted. This upward lifting of the front left corner of the chassis in combination the disengagement of the cam member from the shoulder level means most of the weight attributable to the front part will now be concentrated on the front right wheel, thereby increasing its grip on the ground and will effectively reduce the turning radius to the left in a similar manner.

As a result of the present invention, a toy vehicle employing a conventional steering mechanism in combination with the present arrangement achieves a considerable improvement in the turning capability. While the present invention has been explained with reference to an embodiment which achieves a considerable reduction on the turning radius of a toy vehicle, it should also be appreciated that such arrangements could be adapted to increase the turning radius by reversing the manner in which the contoured step-levels are arranged. Furthermore, it must be emphasised that the scope of the present invention should not be confined to the present embodiment since many other possible equivalent mechanical arrangements could be utilised to achieve the same effect of causing tilting of the plane of the chassis about one of its rear wheels and for increasing the weight on one wheel.

I claim:

1. A toy vehicle comprising:

a rigid chassis;

a steering control mechanism, first and second front wheels which are connected to first and second arms, respectively, and which are located on first and second sides of said vehicle, wherein each said arm is pivotally movable and said pivotal movement is controllable by said steering control mechanism to control the steering of said front wheels, a cam member provided on each said arm such that when said vehicle is caused to turn to a first side, said cam member on said first arm wedges against said chassis; and a first and second set of contoured step-levels on said first and second sides of said chassis respectively, wherein each said set of contoured step-levels comprises a lowest step-level nearest to the ground, a highest step-level furthest away from the ground and a shoulder level in between.

2. A toy vehicle according to claim 1, wherein when said vehicle is caused to turn towards said first side, said cam member on said first side of said chassis will be positioned to be in contact with said lowest step-level of said first set of step-levels.

3. A toy vehicle according to claim 1, wherein when said vehicle is caused to turn towards said second side, said cam member on said second side of said chassis will be positioned to be in contact said lowest step-level of said second set of step-levels.

4. A toy vehicle according to claim 1, wherein when said vehicle is caused to move in a rectilinear manner, said cam members on both said first and second sides of said chassis will be positioned to be in contact with their respective shoulder step-levels.

* * * * *